US007438067B2

(12) United States Patent
Saito et al.

(10) Patent No.: US 7,438,067 B2
(45) Date of Patent: Oct. 21, 2008

(54) METHOD OF CONTROLLING ENGINE USING HEATED EXHAUST GAS SENSOR

(75) Inventors: Tomoaki Saito, Aki-gun (JP); Masanori Matsushita, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 26 days.

(21) Appl. No.: 11/625,424

(22) Filed: Jan. 22, 2007

(65) Prior Publication Data

US 2007/0169464 A1 Jul. 26, 2007

(30) Foreign Application Priority Data

Jan. 24, 2006 (JP) ..... 2006-014761

(51) Int. Cl.
*F02D 41/00* (2006.01)

(52) U.S. Cl. ..... 123/697; 60/274; 60/277; 60/285

(58) Field of Classification Search ..... 123/697; 60/274, 276, 277, 285
See application file for complete search history.

(56) References Cited

U.S. PATENT DOCUMENTS 5,291,673 A * 3/1994 Hamburg et al. ..... 60/274
5,404,718 A * 4/1995 Orzel et al. ..... 60/274
5,616,835 A 4/1997 Schnaibel et al.
6,304,813 B1 10/2001 Ikeda et al.
6,848,439 B2 2/2005 Ohkuma
2005/0016513 A1 1/2005 Ohkuma

FOREIGN PATENT DOCUMENTS

JP 2001-041923 A 2/2001

* cited by examiner

*Primary Examiner*—Stephen K. Cronin
*Assistant Examiner*—J. Page Hufty
(74) *Attorney, Agent, or Firm*—Alleman Hall McCoy Russell & Tuttle LLP

(57) ABSTRACT

A method of controlling an internal combustion engine system. The method comprises supplying a first amount of electric energy to heat to an upstream sensor located in an exhaust gas passage upstream of an exhaust gas after-treatment device and adjusting an air-fuel mixture supplied to the internal combustion engine based on an output of the upstream sensor during a first engine operating condition, and supplying a second amount of electric energy, which is smaller than the first amount, to heat the upstream sensor and adjusting the air-fuel mixture based on an output of a downstream sensor located in the exhaust gas passage and downstream of the exhaust gas after-treatment device during a second engine operating condition.

20 Claims, 6 Drawing Sheets

METHOD OF CONTROLLING ENGINE USING HEATED EXHAUST GAS SENSOR

BACKGROUND

The present description relates to a method of controlling an internal combustion engine, and more particularly relates to a method of feedback controlling an air fuel ratio of air fuel mixture supplied to an internal combustion engine using a heated exhaust gas oxygen sensor.

There is known and presented, for example in U.S. Pat. No. 6,848,439, an exhaust gas oxygen sensor arranged in an exhaust passage between an internal combustion engine and a catalytic converter. The sensor is capable of outputting a signal that corresponds linearly to the oxygen concentration in the exhaust gases. The '439 patent also shows a method of using the sensor output for feedback controlling an air-fuel mixture to an internal combustion engine. The exhaust gas oxygen sensor outputs a linear signal when its temperature is within a higher operative temperature range, between 700-800° C. for example. On the other hand, the sensor outputs a non-linear signal around the stoichiometric air-fuel ratio at a lower operative temperature range, between 300-400° C. for example. The exhaust gas oxygen sensor is provided with a heater, which may be used to heat the sensor temperature to the operative range.

When the exhaust gas oxygen sensor is cooled down after an engine stop and an internal combustion engine is started again, a water content of the exhaust gas or combusted gas may be partly condensed by contacting the sensor surface. If the heater is then used to heat the exhaust gas oxygen sensor, the condensed water may cause the sensor output to degrade. The '439 patent describes a method to avoid such degradation by choosing the lower temperature range as its target temperature. The '439 patent also describes using the sensor at lower operating temperatures to provide feedback control of engine air fuel mixtures around the stoichiometric air fuel ratio within a predetermined time period after an engine start.

However, it is possible under certain circumstances to increase the amount of water in the exhaust gas that condenses on the sensor surface. For example, when hydrogen is used as a fuel instead of fossil fuels, such as gasoline, combustion of hydrogen may create more water in the exhaust gas because hydrogen readily combines with air to produce water. As the amount of the condensed water increases, it may make it difficult to heat the sensor after an engine start, even to the lower target temperature. Further, since combusted hydrogen exhibits lower exhaust gas temperatures, the time period that condensation occurs in the exhaust system can be increased when compared to combusted fossil fuels. The condensation may make it difficult to precisely feedback control the engine air-fuel ratio based on feedback from the sensor output. Consequently, engine emissions and fuel economy may be degraded when exhaust gases condensate into water in the exhaust system.

Therefore, there is a need to improve the prior art method of feedback controlling an air-fuel ratio using a heated exhaust gas oxygen sensor.

SUMMARY

Accordingly, there is provided, in one aspect of the present description, a method of controlling an internal combustion engine system. The method comprises supplying a first amount of electric energy to heat to an upstream sensor located in an exhaust gas passage from the internal combustion engine and upstream of an exhaust gas after-treatment device and adjusting an air fuel mixture supplied to the internal combustion engine based on an output of the upstream sensor during a first engine operating condition. The method further comprises supplying a second amount of electric energy, which is smaller than the first amount, to heat the upstream sensor and adjusting the air-fuel mixture based on an output of a downstream sensor located in the exhaust gas passage and downstream of the exhaust gas after-treatment device during a second engine operating condition.

By adjusting the air fuel-ratio based on an output of the downstream sensor during the second engine operating condition, the air fuel-ratio can be adjusted under less influence from the condensed water. Since the downstream sensor is located downstream of the exhaust gas after-treatment device, much of the water vapor in the exhaust gas may be condensed before the exhaust gases reach the downstream sensor. This allows the downstream sensor to operate with less influence from the condensing water vapor. Therefore, during the second engine operating condition, the engine air fuel ratio can be more precisely adjusted so that engine exhaust emissions and fuel economy may be improved.

In another aspect, the method comprises adjusting an air-fuel mixture supplied to the internal combustion engine by more heavily weighting an output of the downstream sensor than an output of the upstream sensor during a first predetermined period, and adjusting the air-fuel mixture by more heavily weighting the output of the upstream sensor than the output of the downstream sensor after the first predetermined period. By adjusting the air-fuel mixture by more heavily weighting the output of the downstream sensor prior to more heavily weighting the output of the upstream sensor, the air-fuel mixture can be adjusted under less influence of the water in the exhaust gas because the water is less likely to condense as the period goes by and the engine system temperature increases. Therefore, the engine air fuel ratio can be more precisely adjusted over time.

BRIEF DESCRIPTION OF THE DRAWINGS

The advantages described herein will be more fully understood by reading an example of embodiments in which the above aspects are used to advantage, referred to herein as the Detailed Description, with reference to the drawings wherein.

DETAILED DESCRIPTION

Figure 1:
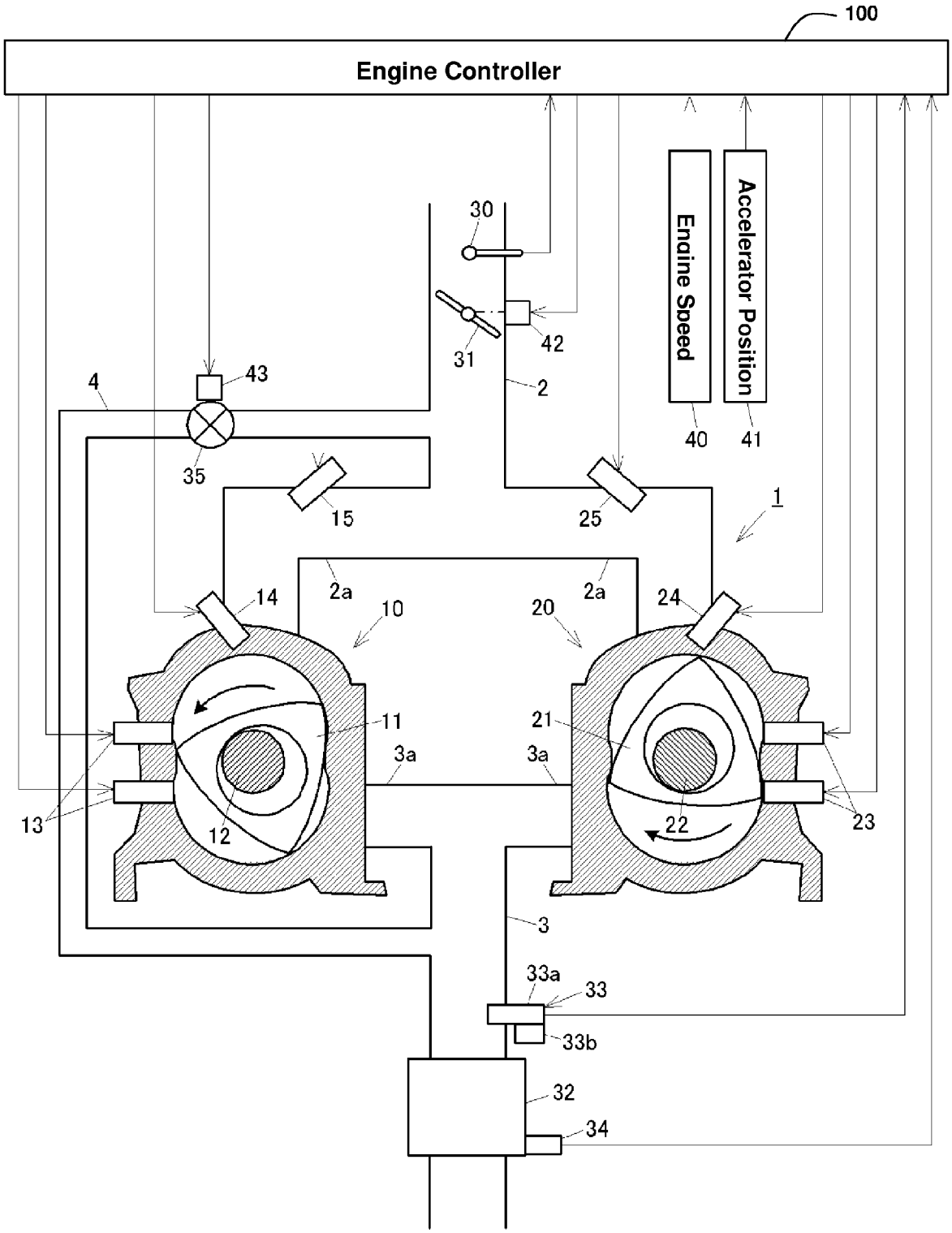
FIG. 1 shows a schematic view of an engine system in accordance with an embodiment of the present description.

An embodiment of the present description will now be described with reference to the drawings, starting with FIG. 1, which shows a schematic view of an engine system including an internal combustion engine 1 fueled with gaseous hydrogen. The engine system is mounted on a vehicle, such as an automotive vehicle, and its output is transmitted to vehicle driving wheels through a power transmission mechanism as is well known in the art.

The engine system comprises an intake air passage 2 for inducting fresh air to the engine 1, an exhaust gas passage 3 for expelling an exhaust gas from the engine 1, and an exhaust gas recirculation (EGR) passage 4 for circulating a part of the exhaust gas back to the intake air passage 2.

The engine 1 is a rotary piston engine having two substantially triangular shaped rotors 11 and 21. The rotary piston engine 1 has two rotor housings 10 and 20, which are arranged at both sides of an intermediate housing not shown and between front and rear housings also not shown. The rotors 11 and 21 are housed respectively within the rotor housings 10 and 20. The inner periphery of the rotor housing 10, the outer periphery of the rotor 11, and the intermediate and front housings collectively define three combustion chambers, while the inner periphery of the rotor housing 20 and the others define three combustion chambers as well. The rotors 11 and 21 are arranged rotatably around eccentric shafts 12 and 22, which have a common rotational axis also common with an output shaft of the engine 1. When the output shaft makes one rotation, each rotor makes three rotations and causes the operational chambers to change the volumes and make an engine cycle (Otto cycle).

An intake port 2*a* is arranged in one of the rotor, intermediate and front or rear housings so as to communicate to a combustion chamber in an intake stroke. Also, an exhaust port 3*a* is arranged in one of the housings so as to communicate to a combustion chamber in an exhaust stroke.

Pairs of spark plugs 13 and 23 are arranged in ones of the housings so as to face a combustion chamber in compression and expansion strokes. The spark plug is coupled to an ignition circuit not shown. The ignition circuit is controlled by an engine controller 100 so that the spark plug can spark at desired timing determined by the engine controller 100.

Direct fuel injectors 14 and 24 are also arranged in one of the housings respectively so as to face an operational chamber in intake and compression strokes. The direct fuel injectors 14 and 24 are supplied with gaseous hydrogen fuel from a hydrogen storage tank, such as a metal hydrate tank, through a fuel supply system not shown. The direct fuel injector has a solenoid valve inside. The solenoid valve is actuated by a driver circuit not shown which is controlled by the engine controller 100. Therefore, the direct fuel injector can directly inject gaseous hydrogen directly into a combustion chamber in a compression stroke or an intake stroke at desired timing determined by the engine controller 100. As is known in the art, when the fuel is injected in a compression stroke, the air-fuel mixture can be combusted even if an overall air fuel ratio of the charged mixture is substantially leaner than the stoichiometry. At that time, the air-fuel mixture is stratified. On the other hand, when the fuel is injected in an intake stroke, the air-fuel mixture will be homogeneous.

Also, port fuel injectors 15 and 25 are arranged in the intake ports 2*a*. The port fuel injector is also supplied with gaseous hydrogen fuel from the hydrogen storage tank through the fuel supply system, and has a solenoid valve that is actuated by a driver circuit which is controlled by the engine controller 100. The port fuel injector can inject gaseous hydrogen into the intake port 2*a* at desired timing determined by the engine controller 100. Therefore, the port fuel injector can inject gaseous hydrogen fuel into the intake port 2*a* at desired timing determined by the engine controller 100. When the injected fuel and air are inducted from the intake port 2*a* into a combustion chamber, the air and fuel mixture is substantially homogeneous.

In the intake passage 2, an airflow meter 30 and a throttle valve 31 are arranged in that order from the upstream side. The airflow meter 30 detects airflow through the intake passage 2 and outputs a corresponding signal to the engine controller 100. A throttle valve actuator 42 actuates the throttle valve 31 and adjusts its opening in accordance with a signal from the engine controller 100.

In the EGR passage 4, an EGR valve 35 is arranged, and actuated by an EGR actuator 43 which adjusts an opening of the EGR valve 35 in accordance with a signal from the engine controller 100.

In the exhaust passage 3, a three-way catalyst converter 32 is arranged. The three-way catalyst converter 32 has a conventional structure comprising a casing and a catalyst brick sustained in the casing. The catalyst brick comprises a honeycomb shaped carrier, and a catalyst layer coated on the carrier. The honeycomb shaped carrier may be made of porous material such as cordierite. Upstream of the catalyst converter 32 in the exhaust passage 3, an upstream oxygen sensor 33 is arranged, which detects a concentration of oxygen in the exhaust gas and outputs electric current in proportion to the detected oxygen concentration as described in greater detail below. It may be called a linear sensor because of linearity of its output.

Downstream of the catalyst converter 32 in the exhaust passage 3, a downstream oxygen sensor 34 is arranged, which also detects a concentration of oxygen in the exhaust gas, but outputs electric current that abruptly changes around the stoichiometric air fuel ratio. Therefore, it may be called a lambda sensor since the stoichiometric air fuel ratio corresponding to an excessive air ratio $\lambda$ (lambda)=1. The downstream sensor may be arranged on the casing of the catalyst converter for a simpler assembly process of an entire exhaust system. It is preferably arranged downstream of the catalyst brick, while it can be arranged between the bricks if there are a plurality of bricks.

Figure 2:
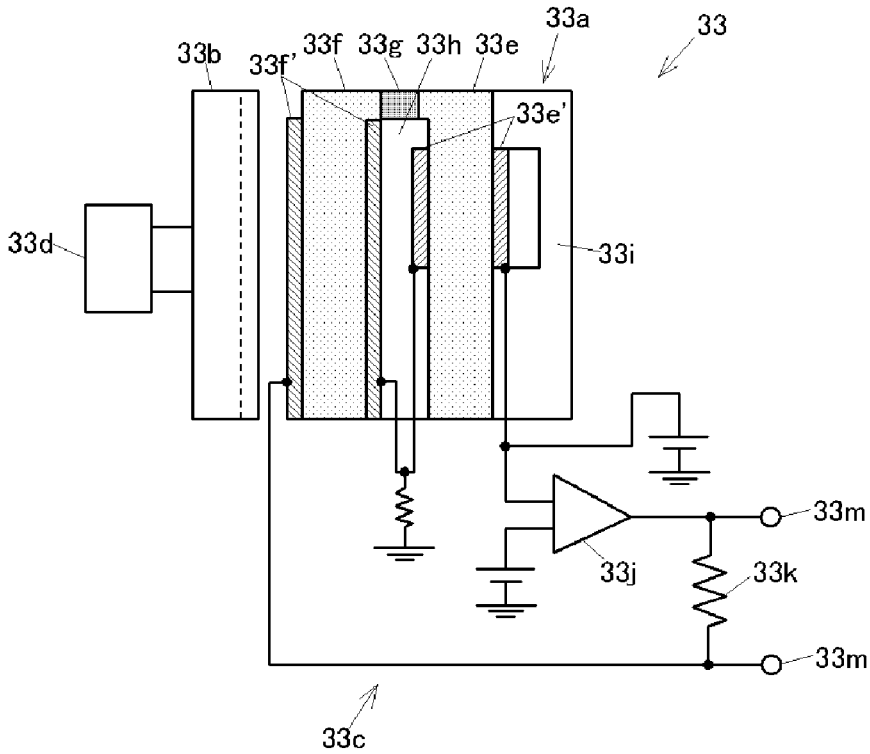
FIG. 2 is a circuit diagram showing an upstream sensor which detects an oxygen concentration in the exhaust gas and has an electric heater in accordance with the embodiment.

FIG. 2 shows a detailed structure of the upstream sensor 33. It comprises a sensor element portion 33*a*, a heater 33*b* that is basically comprised of an electric resistor and arranged in the proximity of the sensor element part 33*a* and can heat it by transmitting electrically generated heat, a sensor circuit 33*c*, and a heater circuit 33*d* that can keep the sensor element portion 33*a* at a predetermined temperature.

The sensor element portion 33*a* has an oxygen cell element 33*e* and an oxygen pump element 33*f* made of oxygen ion conductive solid electrolyte material such as zirconia. The oxygen cell element 33*e* generates electricity at its both sides in dependence on a ratio of oxygen concentrations between at its both sides, while the oxygen pump element 33*f* pumps oxygen from its one side to the other in dependence on electricity applied to its both sides. Electrode layers 33*e*' are formed on the both sides of the oxygen cell element 33*e*, and electrode layers 33*f*' are formed on the both sides of the oxygen pump element 33*f*.

A dispersion chamber 33*h* is defined by the pair of oxygen pump elements 33*e* and 33*f*, a part of a casing of the sensor element 33*a*, and a dispersion layer 33*g*. The dispersion chamber 33*h* communicates with the exhaust passage 3 through the dispersion layer 33*g* so that the exhaust gas flows between the exhaust passage 3 and the dispersion layer 33*g* at constant dispersion rate. A relative oxygen concentration chamber 33*i* is formed at one side of the oxygen cell element 33*e*, and an oxygen concentration therein is maintained constant, for example, by communicating to the atmosphere.

The sensor circuit 33*c* is connected to the sensor element portion 33*a*, and comprises an operational amplifier 33*j*, a resister 33*k*, and output terminals 33*m*.

When the oxygen ion conductive solid electrolyte material used for the oxygen cell element 33*e* and the oxygen pump element 33*f* is arranged between two chambers of different oxygen partial pressures (or concentrations), oxygen ions pass through the element depending on a ratio of the oxygen partial pressures of the both chambers until the equilibrium, and generate electromotive force, thereby functioning as an electric cell. On the other hand, when there is a voltage difference between the both sides of the material, it pumps oxygen from one side to the other.

Then, the operational amplifier 33*j* adjusts current flowing to the oxygen pump element 33*f* in accordance with change of voltage generated at the oxygen cell element 33*e*. When oxygen in exhaust gas in the dispersion chamber 33*h* increases, the oxygen pump element 33*f* pumps out the oxygen from the dispersion chamber 33*h* to the outside. When oxygen in exhaust gas in the dispersion chamber 33*h* decreases, the oxygen pump element 33*f* pumps oxygen into the dispersion chamber 33*h* from the outside. The pumping function of the oxygen pump element 33*e* is going to maintain a state corresponding to the stoichiometric air fuel ratio in the dispersion chamber 33*h*. But, the exhaust gas flows into the dispersion chamber 33*h* through the dispersion layer 33*g* at the constant rate, and the pumping function does not stop unless an oxygen concentration in the dispersion chamber 33*h* matches to the stoichiometric air fuel ratio. Therefore, an amount of the oxygen pumped out by the oxygen pump element 33*f* is in proportion to a difference between an oxygen concentration in the exhaust passage 3 and an oxygen concentration in the dispersion chamber 33*h* which is supposedly corresponding to the stoichiometric air fuel ratio due to the function of the oxygen cell element 33*e*. Then, the current adjusted by the operational amplifier 33*j* for actuating the oxygen pump element 33*f* flows through the resister 33*k*. At the terminals 33*m*, a voltage in proportion to the current and the oxygen concentration in the exhaust passage 3 can be output.

Figure 3:
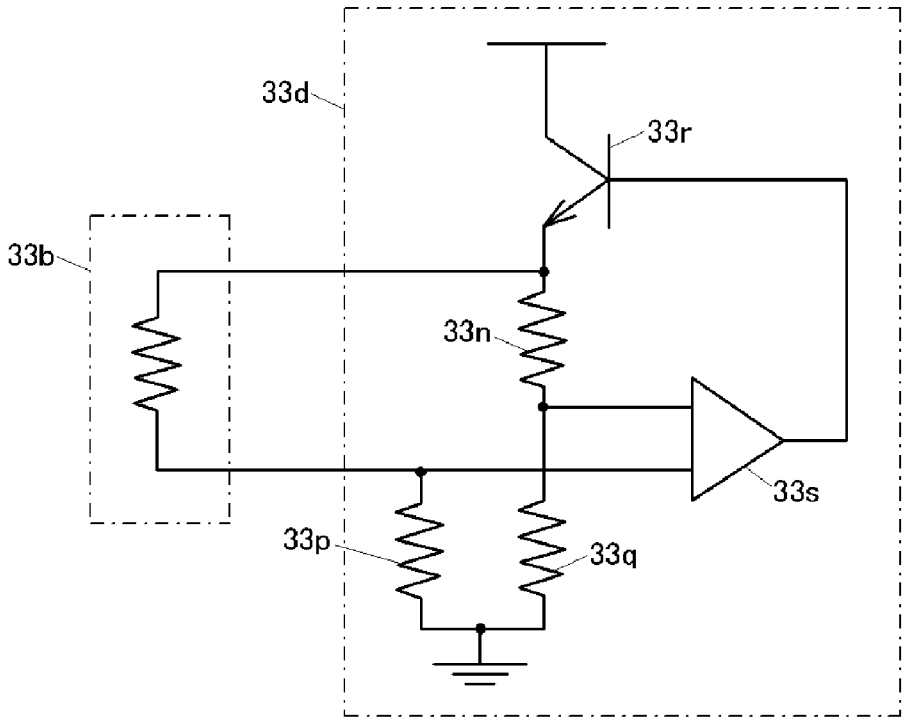
FIG. 3 is a circuit diagram the electric heater of the upstream sensor in accordance with the embodiment.

FIG. 3 shows the heater 33*b* and the heater circuit 33*d*. The heater 33*b* is basically comprised of a resistor, and the heater circuit 33*d* is basically constituted with a bridge circuit including resistors 33*n*, 33*p* and 33*q*, a transistor 33*r*, and an operational amplifier 33*s*. The resistor of the heater 33*b* changes its electric resistance depending on its temperature, as is well known in the art. On the other hand, the resistors 33*n*, 33*p* and 33*q* do not substantially change their resistances. Therefore, a voltage at a point between the heater 33*b* and the resistor 33*p* changes depending on the temperature of the heater 33*b*. On the other hand, a voltage at a point between the resistors 33*n* and 33*q* does not substantially change, therefore it can be used as a reference voltage at the operational amplifier 33*s*. Output of the operational amplifier 33*s* is input to the transistor 33*r*, and it regulates electric current to the heater 33*b* in accordance with the temperature of the heater 33*b*. Therefore, it is feedback controlled to be a temperature corresponding to the reference voltage at the operational amplifier 33*s*. Although it is not shown, electric supply to the heater circuit 33*d* can be shut down by a switching relay or a power transistor known in the art, which is controlled by the engine controller 100.

The downstream lambda sensor 34 basically consists of an oxygen cell element, and does not have an oxygen pump element. Therefore, an output signal of the downstream lambda sensor 34 rapidly changes between below and above a predetermined oxygen concentration. That is, the lambda sensor 34 outputs voltage of about 1 volt at an oxygen concentration of exhaust gas generated when mixture richer than the stoichiometric air fuel ratio is combusted and flows, and outputs voltage of about 0 volt when mixture leaner than the stoichiometric air fuel ratio is combusted and flows. Consequently, it is possible to determine an air fuel ratio of mixture supplied to a combustion chamber is richer or leaner than the stoichiometric air fuel ratio.

By arranging the linear oxygen sensor 33 and the lambda oxygen sensor 34 upstream and downstream of the three way catalyst converter 32, degradation of the catalyst 32 can be detected. In particular, when the catalyst 32 functions normally, oxygen in exhaust gas is adsorbed by the catalyst 32 so that an oxygen concentration detected by the downstream lambda sensor 34 is relatively smaller than an oxygen concentration detected by the upstream linear sensor 33. However, when the catalyst 32 is degraded, oxygen storage capacity is decreased so that detected values by the both sensors 33 and 34 are made similar, and based on this, the degradation of the catalyst 32 can be detected. Also, by providing the two sensors 32 and 33, a variation caused by an individual difference or aging can be adjusted as well.

The engine controller 100 is a microprocessor based controller well known in the art, and as shown in FIG. 1, receives signals from the airflow meter 30, the upstream linear sensor 33, the downstream lambda sensor 34, an engine speed sensor 40 for detecting an engine rotational speed, an accelerator sensor detecting a position of an accelerator pedal which a driver operates, and other sensors. Based on those input signals, the engine controller 100 computes and outputs signals directly or indirectly, for example through a driver circuit, to the fuel injectors 14, 15, 24, and 25, the spark plugs 13 and 23, the throttle actuator 42, the EGR actuator 43, the switching relay of the heater 33*b* of the upstream linear sensor 33, and other actuators. Although the heater circuit 33*d* adjusts electricity supplied to the heater 33*b* of the upstream linear sensor 33, the engine controller may digitally perform the same function as the analogue heater circuit 33*d* does.

Figure 4:
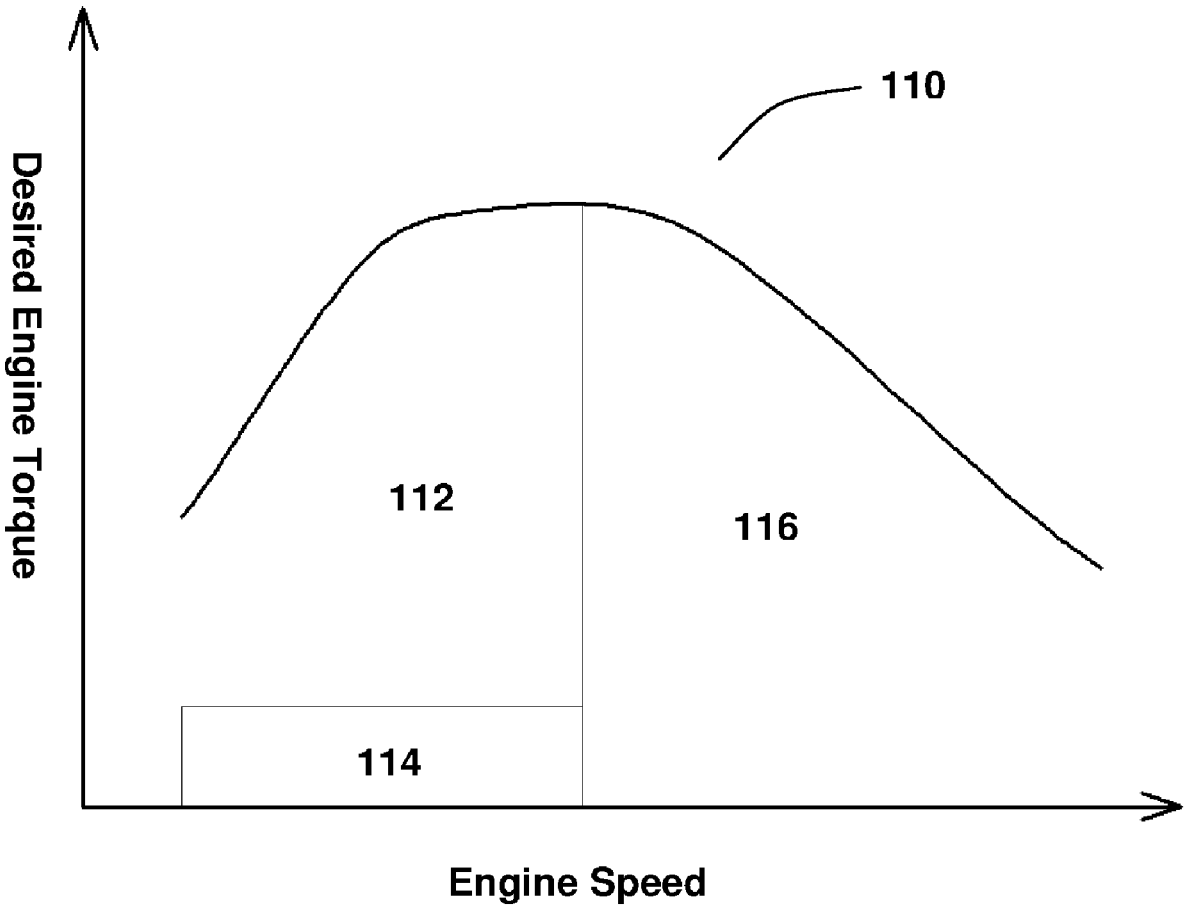
FIG. 4 is a map which defines engine operating regions on an engine speed and desired engine torque.

The engine controller 100 stores in its memory an operational map 110, as shown in FIG. 4, which defines three operational modes in accordance with an engine speed which is detected by the engine speed sensor 40 and a desired engine torque which predominantly corresponds to the signal output from the accelerator sensor 41. The operational map defines a $\lambda=1$ mode in a lower speed and higher torque region 112, a lean mode ($1<\lambda\approx2$) in a lower speed and lower torque region 114, and a high power lean region ($\lambda=1.4$-$1.6$) in a higher speed region 116.

The engine controller 100 computes a target opening of the throttle valve 31 based on the desired torque, the engine speed and the target air fuel ratio, and controls the throttle actuator 42 to meet the target throttle opening. A base fuel injection amount is computed based on the desired torque, the engine speed and the target air fuel ratio, as well.

When a predetermined time period, for example two minutes, has passed, the engine controller 100 adjusts an air fuel ratio of air and fuel mixture supplied to the engine 1 with reference to the operational map 100. At this time, the engine controller 100 closed the switching relay or power transistor between the power supply and the heater circuit 33*d* of the upstream linear sensor. Therefore, the heater 33*b* can receive electricity and maintain the upstream sensor 33 at the predetermined temperature, therefore the sensor 33 is fully operative. The fuel injection amount is feedback controlled using based on the base fuel injection amount and the output of the upstream linear oxygen sensor 33 to meet the target air fuel ratio. At this time, the output of the downstream lambda sensor 34 may be used for a correction of the output of the upstream linear sensor 33.

In the lower speed and higher torque region 112, a target air fuel ratio is set the stoichiometric air fuel ratio (corresponding to λ=1). The EGR valve 35 is opened so that the exhaust gas is re-circulated through the EGR passage 4 to the intake passage 2. The exhaust gas re-circulated into the combustion chamber decreases a combustion temperature, and reduces NOx generation during the combustion. The direct fuel injectors 14 and 24 inject fuel directly to the combustion chambers.

In the lower speed and lower torque region 114, the target air fuel ratio is set an air fuel ratio leaner than the stoichiometric air fuel ratio, for example corresponding to λ=2. The EGR valve 35 is closed, and direct fuel injectors 14 and 24 inject fuel directly to the combustion chambers.

In the higher speed region, the target air fuel ratio is set an air fuel ratio leaner than the stoichiometric air fuel ratio, for example corresponding to λ=1.4-1.6, which is, in the case of using gaseous hydrogen as fuel, the leanest air fuel ratio as far as pre-ignition that is self ignition before spark ignition by the spark plugs 13 or 23 does not occur. The EGR valve 35 is closed. The direct fuel injectors 14 and 24 inject fuel directly to the combustion chambers, and at the same time, the port fuel injectors 15 and 25 inject fuel to the intake ports 2*a*, for higher engine output.

Figure 5:
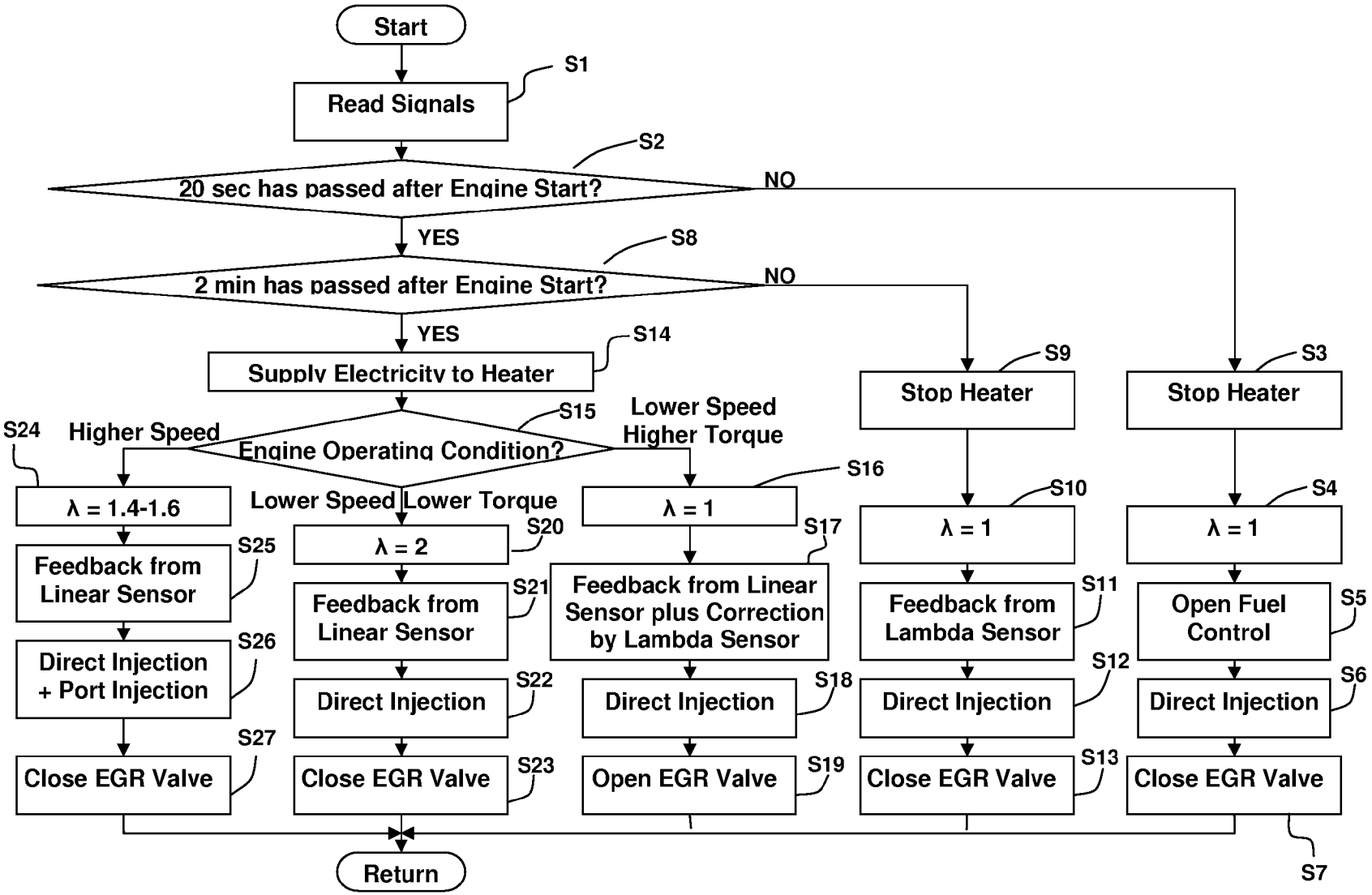
FIG. 5 is a flowchart showing a routine to control the engine system in accordance with the embodiment of the present description.

Control of the engine system, particularly the fuel injectors 14, 15, 24, and 25, and the EGR valve 35 will now be described with reference to a flowchart of FIG. 5 showing a control routine executed by the engine controller 100. At a step S1, the engine controller 100 reads various signals from the airflow meter 30, the upstream linear sensor 33, the downstream lambda sensor 34, the engine speed sensor 40, and the others. The routine proceeds to a step S2, and determines whether or not 20 seconds has passed since an engine start by reading a counter which is integrated into the engine controller 100 as is well known in the art, and has started when the engine 1 is determined to start a self rotation and counts up as time goes by. Alternatively, the counter may count number of rotations of the engine 1 or number of combustion cycles of the engine 1, from the fuel injection pulse signal sent to the fuel injectors from the engine controller 100.

If it is determined that 20 seconds has not passed since the engine start at the step S2 (NO), the routine proceeds to a step S3, and stops to supply electricity to the heater 33*b* of the upstream linear sensor 33, for example by the engine controller 100 controlling to open the switching relay. Then, it proceeds to a step S4, and sets the target air fuel ratio to correspond to λ=1. After the step S4, the routine proceeds to a step S5, and computes the base fuel injection amount based on the engine speed, the desired torque and the target air fuel ratio without taking account of the outputs of either of the upstream linear sensor 33 or the downstream lambda sensor 34 (open control). Then, it proceeds to a step S6, and the engine controller 100 actuates the direct fuel injectors 14 and 24 to inject the base fuel amount determined at the step S5 at a desired timing without actuating the port fuel injectors 15 and 25 (direct injection). At the same time, the engine controller 100 controls the throttle actuator 42 to regulate intake airflow to the engine 1, thereby causing the direct fuel injectors 14 and 24 and the throttle valve 31 to function collectively as an air-fuel regulator to adjust the air-fuel mixture supplied to the engine 1. Finally, the routine proceeds to a step S7, and the engine controller 100 controls the EGR actuator 43 to close the EGR valve 35. Then, the routine returns.

Figure 6:
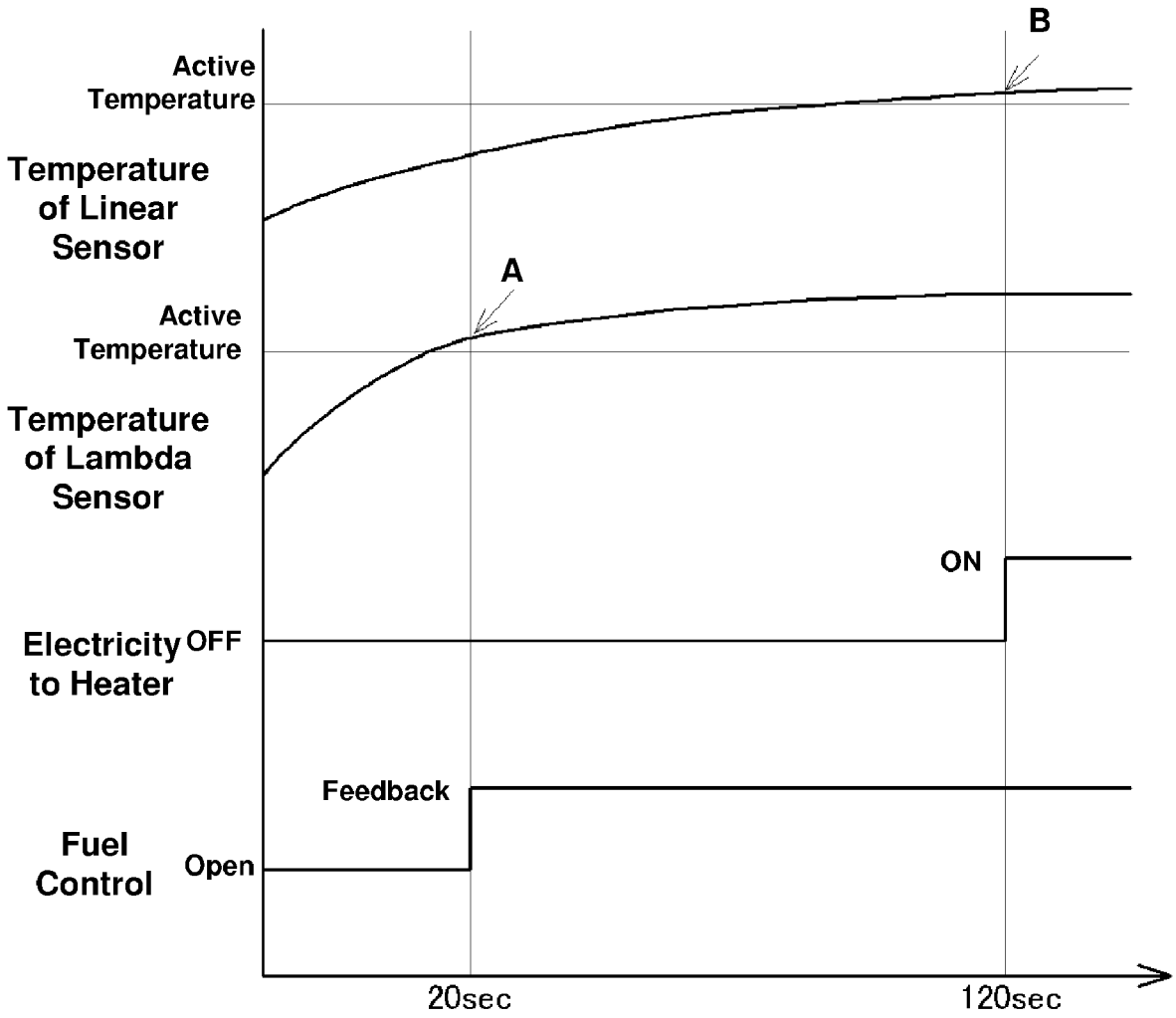
FIG. 6 shows time charts of temperatures of exhaust gas oxygen sensors, heater control, and fuel control.

During the steps S3 through S7, as shown in a time chart of FIG. 6, the upstream linear sensor 33 and the downstream lambda sensor 34 are likely not to reach active temperatures. Then, it may be difficult to make precise feedback control based on the outputs of these sensors 33 and 34. Therefore, the feedback control is not made, but the open control is made with the target air fuel ratio to be the stoichiometry. At this time, catalytic reaction of the exhaust gas over the three-way catalyst converter 32 occurs and generates heat to increase the gas temperature downstream of the catalyst converter 32. Therefore, the downstream lambda sensor 34 increases its temperature at a greater rate, as shown in FIG. 6 by a line A. The time period of 20 seconds for the determination at the step S2 may be predetermined from an experiment or test, not limited to 20 seconds, but may be a time period sufficient for the lambda sensor 34 to reach the active temperature.

On the other hand, if at the step S2, it is determined that 20 seconds has passed after the engine start (YES), since it is a state where the downstream lambda sensor 34 has reached the active temperature (see the line A in FIG. 6), but the upstream linear sensor 33 has not reached the active temperature (see the line B in FIG. 6). Therefore, the routine proceeds to a step S8, and determines whether or not two minutes has passed after the engine start by reading the counter described above. If it is determined that two minutes has not passed after the engine start at the step S8 (NO), the routine proceeds to a step S9, and continues to stop electricity supply to the heater of the linear sensor 33. Then, it proceeds to a step S10, and sets the target air fuel ratio to correspond to λ=1. After the step S10, the routine proceeds to a step S11, and computes the base fuel injection amount based on the engine speed, the desired torque and the target air fuel ratio, and computes the fuel injection amount based on the base fuel injection amount and an output signal from the downstream lambda sensor 34 (feedback control). Then, it proceeds to a step S12, and the engine controller 100 actuates the direct fuel injectors 14 and 24 at a desired timing without actuating the port fuel injectors 15 and 25 (direct injection). Finally, the routine proceeds to a step S13, and the engine controller 100 controls the EGR actuator 43 to close the EGR valve 35. Then, the routine returns.

During the steps S9 through S13, the downstream lambda sensor 34 has reached the active temperature as shown in FIG. 6. Also, even if the exhaust gas temperature is lower and water content of the exhaust gas is likely to condense, the catalyst converter 32, particularly the honeycomb shaped carrier of the catalyst brick, may block the water content from getting condensed on the downstream lambda sensor. Therefore, the air fuel ratio can be precisely feedback controlled to be the stoichiometry (λ=1). This feedback control is configured that the output signal by the lambda sensor 34 and a signal corresponding to the stoichiometric air fuel ratio (λ=1) are compared, and based on this comparison result, a correction amount to correct the base fuel injection amount is calculated. Alternatively, while still heavily weighting the output of the lambda sensor 34, the output of the upstream linear sensor 33 may be taken account of to some extent for a purpose of watching the function of the lambda sensor 34.

Then, the combustion at λ=1 raises a temperature of exhaust gas, and may promote heating of the linear sensor 33. The time period of two minutes for the determination at the step S8 may be predetermined from an experiment or test, not limited to two minutes, but may be a time period sufficient for the linear sensor 34 to reach the active temperature. Further, it may be number of rotations or combustion events of the engine 1 as described above.

Also, if it is determined that two minutes has passed after the engine start at the step S8 (YES), it is a state where both of the linear sensor 33 and the lambda sensor 34 have reached the active temperatures (see the line B of FIG. 6). The routine proceeds to a step S14, and supplies electricity the heater 33*b* through the heater circuit 33*d* of the linear sensor 33 by the engine controller 100 closing the switching relay. Then, the heater circuit 33*d*, as described above, controls the heater 33*b* to maintain the linear sensor 33 at the predetermined temperature. Then, the routine proceeds to a step S15, and determines the engine operating condition is in which of the regions 112, 114, and 116 in the map 110 of FIG. 4, based on the desired torque and the engine speed.

If it is determined at the step S15 that the engine operating condition is in the lower speed and higher torque region 112, the routine proceeds to a step S16, and sets the target air fuel ratio to be the stoichiometry (λ=1). Then, it proceeds to a step S17, and feedback controls the air fuel ratio (λ=1) based on the output of the upstream linear sensor 33 that has reached the active temperature as described above. This feedback control is configured that the output signal of the linear sensor 33 and a value corresponding to the stoichiometric air fuel ratio (λ=1) are compared, and based on this comparison result, a feedback amount for the base fuel injection amount is calculated.

Further the feedback correction amount to the base fuel injection amount at the step S17 is corrected by the output of the lambda sensor 34. That is, the output signal of the lambda air fuel ratio sensor 34 and the stoichiometric air fuel ratio (λ=1) are compared. Based on the comparison result, the feedback amount for the basic fuel injection amount is corrected. In particular, if an air fuel ratio corresponding to the output of the lambda sensor 34 is determined leaner than the stoichiometric air fuel ratio, the feedback amount by the output of the linear sensor 33 is decrementally corrected by a predetermined amount, and if the lambda sensor 34 determines it is richer than the stoichiometry, the feedback correction amount by the output of the linear sensor 33 is incrementally corrected by a predetermined amount.

After the step S17, the routine proceeds to a step S18, and the engine controller 100 actuates the direct fuel injectors 14 and 24 at a desired timing without actuating the port fuel injectors 15 and 25 (direct injection). Finally, the routine proceeds to a step S19, and the engine controller 100 controls the EGR actuator 43 to open the EGR valve 35 to re-circulate part of exhaust gas to the intake passage 2 through the EGR passage 4. With this exhaust gas recirculation, the combustion temperature can be decreased to reduce the NOx emission. Then, the routine returns.

If it is determined at the step S15 that the engine operating condition is in the lower speed and lower torque region 114, the routine proceeds to a step S20, and sets the target air fuel ratio to be an air fuel ratio leaner than the stoichiometry (λ=2). Then, it proceeds to a step S21, and feedback controls the air fuel ratio (λ=2) based on the output of the upstream linear sensor 33 that has reached the active temperature as described above. This feedback control is configured that the output signal of the linear sensor 33 and a value corresponding to the target lean air fuel ratio (λ=2) are compared, and based on this comparison result, a feedback amount for the base fuel injection amount is calculated.

Figure 7:
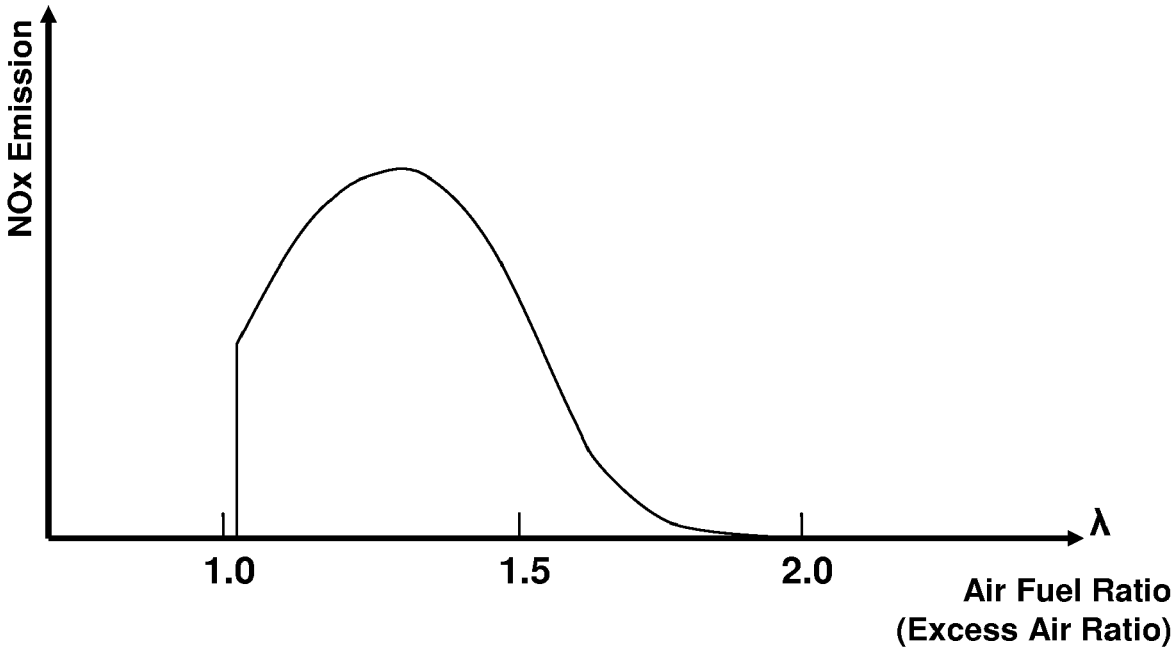
FIG. 7 shows a graph of NOx emission versus air fuel ratios.

FIG. 7 shows a relationship between NOx emission and an excess air ratio λ. The NOx emission increases from a little more than λ=1 corresponding to the stoichiometric air fuel ratio to λ=1.3. Then, it decreases to approximately zero around λ=1.8-2.0. Accordingly, when the operating condition is in the lower speed and lower torque region 112, the target air fuel ratio will be set corresponding to λ=2 for the substantially zero NOx emission.

After the step S21, the routine proceeds to a step S22, and the engine controller 100 actuates the direct fuel injectors 14 and 24 at a desired timing without actuating the port fuel injectors 15 and 25 (direct injection). Finally, the routine proceeds to a step S23, and the engine controller 100 controls the EGR actuator 43 to close the EGR valve 35. Then, the routine returns.

If it is determined at the step S15 that the engine operating condition is in the higher speed region 114, the routine proceeds to a step S24, and sets the target air fuel ratio to be an air fuel ratio leaner than the stoichiometry (λ=1.4-1.6). Then, it proceeds to a step S25, and feedback controls the air fuel ratio (λ=1.4-1.6) based on the output of the upstream linear sensor 33 that has reached the active temperature as described above. This feedback control is configured that the output signal of the linear sensor 33 and a value corresponding to the target lean air fuel ratio (λ=1.4-1.6) are compared, and based on this comparison result, a feedback amount for the base fuel injection amount is calculated. Then, the routine proceeds to a step S26, and the engine controller 100 actuates the direct fuel injectors 14 and 24 and the port fuel injectors 15 and 25 at respective desired timings (direct injection plus port injection). At the same time, the engine controller 100 controls the throttle actuator 42 to regulate intake airflow to the engine 1, thereby causing the direct fuel injectors 14 and 24, the port fuel injectors 15 and 25 and the throttle valve 31 to function collectively as the air-fuel regulator to adjust the air-fuel mixture supplied to the engine 1. Finally, the routine proceeds to a step S27, and the engine controller 100 controls the EGR actuator 43 to close the EGR valve 35. Then, the routine returns.

As described above, in an engine start, electricity supplied to the heater 33*b* of the upstream linear sensor is stopped at the step S3 or S8 until two minutes after an engine start when it is supposed that the upstream linear sensor 33 has reached the active temperature and there is substantially no condensed water on the surface of the upstream linear sensor. Therefore, the linear sensor 33 may not have any distortion on its surface due to the condensed water and the heater.

During this two minute period, the downstream lambda sensor 34 arranged has substantially no condensed water on its surface thanks to the catalyst converter 32 arranged upstream of the downstream lambda sensor 34. Also, the exhaust gas reacted and heated at the catalyst converter 32 may cause the lambda sensor 34 to more quickly reach the active temperature so that the air fuel ratio can be precisely feedback controlled based on the output of the lambda sensor 34.

In the embodiment above, the oxygen sensors 33 and 34 are supposed to reach the respective active temperatures by determining a time period since an engine start at the steps S2 and S8. Alternatively, a temperature sensor may be provided and detect a temperature of the linear sensor 33 or the lambda sensor 34. Then, at the step S2 or S8 of the control routine of FIG. 5, it may be determined whether or not the detected temperature of the sensor 33 or 34 is higher than a predetermined temperature. Further alternatively, the temperatures of the sensors 33 and 34 may be estimated based on cumulated rotations of the engine 1 since an engine start, cumulated fuel injection amount since an engine start, other parameters including the time period since an engine start, an engine temperature, and an atmospheric temperature, or a combination of any of the above.

The engine 1 is not limited to the rotary piston engine, but may be any type of internal combustion engines including a spark ignited engine having a reciprocating piston with direct fuel injection or port fuel injection. The fuel supplied to the engine is not limited to the gaseous hydrogen described above, but it may be hydrocarbon based fuels including gasoline, diesel oil and ethanol.

The upstream sensor 33 is not limited to the specific type of linear sensor described above, but may be a different type of sensor showing a linearity of the output without the oxygen pump element, or a lambda sensor like the downstream sensor 34 if the target air fuel ratio is always set the stoichiometry.

The heater 33*b* and the heater circuit 33*d* are not limited to the above described. Specifically, instead of turning on and off the electricity to the heater, the engine controller 100 may adjust the electricity by controlling a power transistor such as the transistor 33*r* in FIG. 3. In that case, instead of stopping the electricity to the heater 33*b* at the steps S3 and S9, small amount of electricity can be supplied to the heater 33*b*. That amount is much smaller than what may be supplied at the step S14. Then, the upstream linear sensor can more quickly reach the active temperature without a risk of the excessive surface distortion.

While in the above embodiment, the downstream sensor 34 does not have any heater, the sensor 34 may have an electric heater. Since the downstream sensor 34 is arranged downstream of at least one brick of the catalyst converter 33 which blocks water from condensing on the sensor 34, the heater of the downstream sensor 34 may be activated just after an engine start so that an air fuel ratio feedback control can be started further earlier.

It is needless to say that the invention is not limited to the illustrated embodiments and that various improvements and alternative designs are possible without departing from the substance of the invention as claimed in the attached claims.

The invention claimed is:

1. A method of controlling an internal combustion engine, comprising:

supplying a first amount of electric energy to heat an upstream sensor located in an exhaust gas passage from said internal combustion engine and upstream of an exhaust gas after-treatment device and adjusting an air-fuel mixture supplied to said internal combustion engine based on an output of said upstream sensor during a first engine operating condition; and supplying a second amount of electric energy, which is smaller than the first amount, to heat said upstream sensor and adjusting the air-fuel mixture based on an output of a downstream sensor located in said exhaust gas passage and downstream of said exhaust gas after-treatment device during a second engine operating condition.

2. The method as described in claim 1, wherein the air-fuel mixture is feedback controlled based on the output of said upstream or downstream sensor.

3. The method as described in claim 2, wherein said upstream and downstream sensors detect an oxygen concentration in said exhaust passage.

4. The method as described in claim 2, wherein the air-fuel mixture is feedback controlled around a stoichiometric air fuel ratio during said second engine operating condition.

5. The method as described in claim 4, wherein the air-fuel mixture is feedback controlled around an air fuel ratio leaner than the stoichiometric air fuel ratio during said first engine operating condition.

6. The method as described in claim 1, wherein the first amount of electric energy is adjusted to feedback control a temperature of said upstream sensor.

7. The method as described in claim 1, wherein the second amount of electric energy is zero.

8. The method as described in claim 1, wherein a temperature of said upstream sensor is above a predetermined temperature during said first engine operating condition and below said predetermined temperature during said second engine operating condition.

9. The method as described in claim 8, wherein said first amount of electric energy is adjusted to regulate the temperature of said upstream sensor to a temperature which is higher than said predetermined temperature.

10. The method as described in claim 1, wherein said second operating condition occurs within a predetermined period after an engine start.

11. The method as described in claim 10, wherein said predetermined period is a time period.

12. The method as described in claim 10, wherein said predetermined period is number of engine combustion events.

13. A method of controlling an internal combustion engine system having an upstream sensor located in said exhaust gas passage from an internal combustion engine and upstream of an exhaust gas after-treatment device and a downstream sensor located in said exhaust gas passage and downstream of said exhaust gas after-treatment, comprising:

adjusting an air-fuel mixture supplied to said internal combustion engine by more heavily weighting an output of said downstream sensor than an output of said upstream sensor during a first predetermined period; and adjusting the air-fuel mixture by more heavily weighting the output of said upstream sensor than the output of said downstream sensor after said first predetermined period.

14. The method as described in claim 13, wherein the air fuel mixture is feedback controlled based on the output of said upstream or downstream sensor.

15. The method as described in claim 14, further comprising adjusting the air-fuel mixture without said feedback control during a second predetermined period before said predetermined period.

16. The method as described in claim 13, further comprising supplying electric energy to heat said upstream sensor after said first predetermined period.

17. The method as described in claim 16, wherein the air-fuel mixture is feedback controlled around an air fuel ratio leaner than a stoichiometric air fuel ratio based on the output of said upstream sensor after said first predetermined period.

18. An engine system comprising:

an internal combustion engine;

an air-fuel regulator configured to adjust an air-fuel mixture supplied to said internal combustion engine;

an exhaust gas passage through which exhaust gas flows from said internal combustion engine;

an exhaust gas after-treatment device arranged in said exhaust gas passage;

an upstream sensor arranged in said exhaust gas passage and between said internal combustion engine and said exhaust gas after-treatment device and configured to detect an oxygen concentration in the exhaust gas and to output a first signal;

an electric heater capable of heating said upstream sensor with supplied electricity;

a downstream sensor arranged in said exhaust gas passage and downstream of said exhaust gas after-treatment device and configured to detect an oxygen concentration in the exhaust gas and to output a second signal: and a controller configured to control the supplied electricity to said electric heater to be greater during a first engine operating condition than during a second engine operating condition, and to control said air-fuel regulator to adjust an air-fuel mixture supplied to said internal combustion engine based on said first signal during said first engine operating condition and on said second signal during said second engine operating condition.

19. The engine system as described in claim 18, further comprising a counter configured to count an elapsed period since an engine start, and wherein said controller is further configured to determine a transition from said second engine operating condition to said first engine operating condition when said counter has counted a predetermined value.

20. The engine system as described in claim 18, wherein hydrogen is supplied to said internal combustion engine as fuel.

* * * * *